US010685801B2

(12) United States Patent
Shimoda et al.

(10) Patent No.: US 10,685,801 B2
(45) Date of Patent: Jun. 16, 2020

(54) ELECTROMAGNETIC DEVICE AND ELECTROMAGNETIC RELAY USING SAME

(71) Applicant: OMRON Corporation, Kyoto (JP)

(72) Inventors: Seiki Shimoda, Kumamoto (JP); Tsuyoshi Okubo, Kumamoto (JP)

(73) Assignee: Omron Corporation, Kyoto (JP)

( * ) Notice: Subject to any disclaimer, the term of this patent is extended or adjusted under 35 U.S.C. 154(b) by 132 days.

(21) Appl. No.: 15/876,072

(22) Filed: Jan. 19, 2018

(65) Prior Publication Data

US 2018/0144895 A1 May 24, 2018

Related U.S. Application Data

(63) Continuation of application No. PCT/JP2016/075079, filed on Aug. 26, 2016.

(30) Foreign Application Priority Data

Sep. 11, 2015 (JP) ..... 2015-179236

(51) Int. Cl.
*H01H 9/00* (2006.01)
*H01H 50/44* (2006.01)
(Continued)

(52) U.S. Cl.
CPC ..... *H01H 50/44* (2013.01); *H01H 9/161* (2013.01); *H01H 50/04* (2013.01); *H01H 50/06* (2013.01);
(Continued)

(58) Field of Classification Search
CPC ... H01H 50/04–08; H01H 50/36; H01H 50/44
(Continued)

(56) References Cited

U.S. PATENT DOCUMENTS 2,131,942 A * 10/1938 Evans ..... B60Q 1/1415 361/210
3,037,106 A * 5/1962 Seuey ..... H05B 1/0213 219/471
(Continued)

FOREIGN PATENT DOCUMENTS

CN 101677043 A 3/2010
CN 103515046 A 1/2014
(Continued)

OTHER PUBLICATIONS

International Search Report issued in PCT/JP2016/075079, dated Nov. 15, 2016 (2 pages).
(Continued)

*Primary Examiner* — Shawki S Ismail
*Assistant Examiner* — Lisa N Homza
(74) *Attorney, Agent, or Firm* — Osha Liang LLP

(57) ABSTRACT

An electromagnetic device includes a spool having a cylindrical body with a through hole, a secondary coil formed in a spiral shape along an outer peripheral surface of the cylindrical body and formed with a closed circuit by metal plating, and a primary coil formed of a conductive wire wound around the secondary coil via an insulating material covering the secondary coil. An induced current, generated by applying a voltage to any one of the primary coil and the secondary coil, is allowed to flow to the other coil different from the one coil.

6 Claims, 8 Drawing Sheets

(51) Int. Cl.

| | |
|---|---|
| ***H01H 50/08*** | (2006.01) |
| ***H01H 9/16*** | (2006.01) |
| ***H01H 50/04*** | (2006.01) |
| ***H01H 50/06*** | (2006.01) |
| ***H01H 50/36*** | (2006.01) |

(52) U.S. Cl.
CPC ..... *H01H 50/08* (2013.01); *H01H 50/36* (2013.01); *H01H 2050/446* (2013.01)

(58) Field of Classification Search
USPC ..... 335/180
See application file for complete search history.

(56) References Cited

U.S. PATENT DOCUMENTS 5,160,910 A * 11/1992 Tsuji ..... H01H 50/642 335/121
5,396,204 A * 3/1995 Matsuoka ..... H01H 50/04 335/78
6,498,552 B1 * 12/2002 Lozano Rico ..... H01H 50/021 335/124
6,924,719 B2 * 8/2005 Saruwatari ..... H01H 50/08 335/17
7,034,643 B1 * 4/2006 Kusumoto ..... F02N 15/067 335/126
7,038,564 B1 * 5/2006 Kusumoto ..... F02N 11/00 335/126
9,076,617 B2 * 7/2015 Yamashita ..... H01H 9/40
9,082,575 B2 * 7/2015 Yamashita ..... H01H 9/443
9,123,494 B2 * 9/2015 Shinkai ..... H01H 51/06
9,136,080 B2 * 9/2015 Sumino ..... H01H 50/20
9,437,382 B2 * 9/2016 Kato ..... H01F 5/04
2010/0073117 A1 3/2010 Daijima

FOREIGN PATENT DOCUMENTS

JP S51-065244 U 5/1976
JP S59-090156 U 6/1984
JP H03-254035 A 11/1991

OTHER PUBLICATIONS

Written Opinion issued in PCT/JP2016/075079, dated Nov. 15, 2016 (4 pages).
Office Action issued in Chinese Application No. 201680040700.0 dated Sep. 5, 2018 (9 pages).

* cited by examiner

ELECTROMAGNETIC DEVICE AND ELECTROMAGNETIC RELAY USING SAME

BACKGROUND

Technical Field

The present invention relates to an electromagnetic device, particularly an electromagnetic device incorporated into an electromagnetic relay by winding a coil twice, and an electromagnetic relay using this electromagnetic device.

Related Art

As an electromagnetic device with a double-wound coil, for example, a bobbin complete body 111 has been used which is formed by winding a coil 112 in two layers around a bobbin 113, as illustrated in FIG. 8 of Patent Document 1. In FIG. 8, an electromagnetic relay in which the bobbin complete body 111 is incorporated into a base 116 is disclosed.

Patent Document 1: Japanese Unexamined Patent Publication No. H3-254035

SUMMARY

However, the coil 112 is wound in two layers on the bobbin 113, so that the bobbin complete body 111 becomes bulky and the device cannot be made more compact in size.

In the bobbin complete body 111, it is necessary to wind extended wires 112*a*, 112*a*' of the coil 112 around external connection terminals 114*a*, 114*a*'. Similarly, it is necessary to wind extended wires 112*b*, 112*b*' of the coil 112 around external connection terminals 114*b*, 114*b*'. For this reason, with the bobbin complete body 111, it takes time and effort to do connection work on the coil 112 and the productivity is thus low.

One or more embodiments of the present invention provides an electromagnetic device compact in size and with high productivity and an electromagnetic relay using the electromagnetic device.

An electromagnetic device according to one or more embodiments of the present invention is provided with: a spool having a cylindrical body with a through hole; a secondary coil formed in a spiral shape along an outer peripheral surface of the cylindrical body and formed with a closed circuit by metal plating; and a primary coil formed of a conductive wire wound around the secondary coil via an insulating material covering the secondary coil. An induced current, generated by applying a voltage to any one of the primary coil and the secondary coil, is allowed to flow to the other coil different from the one coil.

According to one or more embodiments of the present invention, with the secondary coil formed by metal plating, an electromagnetic device more compact in size and smaller in bulk than that of the conventional example can be obtained. Further, according to the above aspect of the present invention, there is no need to bind the extended wire of the coil to the coil terminal as in the conventional example, thus facilitating the connection work, so that an electromagnetic device with high productivity can be obtained.

BRIEF DESCRIPTION OF THE DRAWINGS

Embodiments the present invention will become apparent from the following description in conjunction with embodiments with reference to the accompanying drawings. In the drawings.

DETAILED DESCRIPTION

Figure 1:
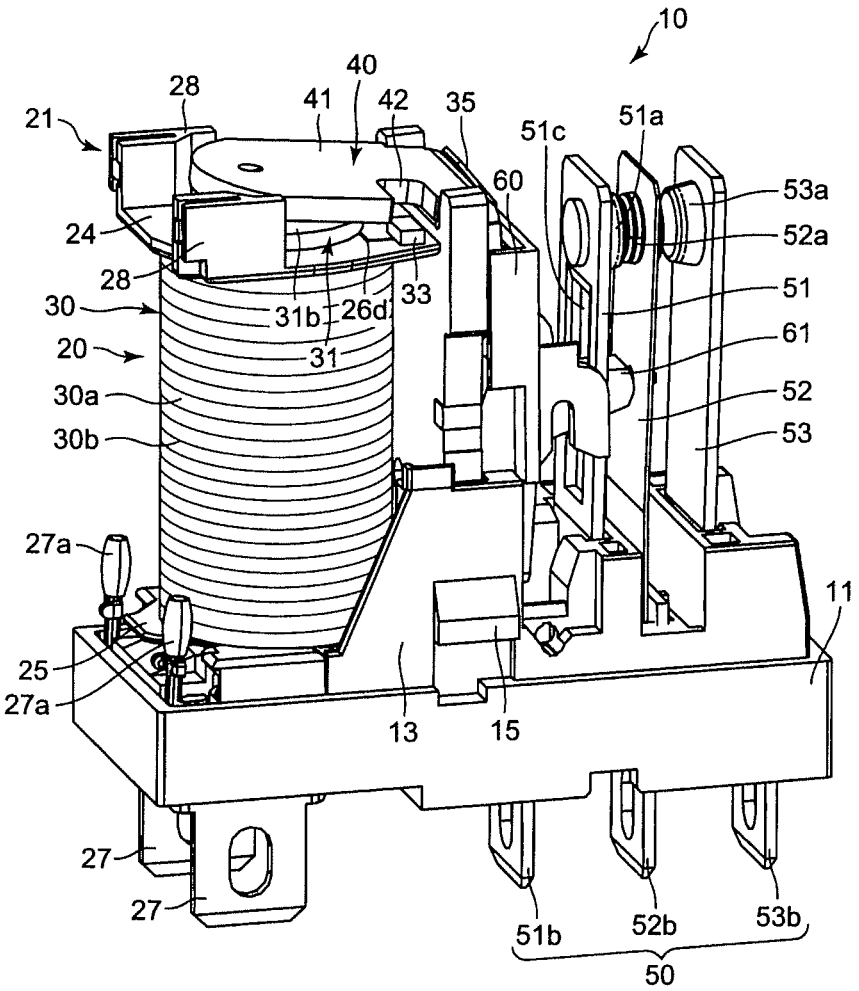
FIG. 1 is a perspective view illustrating an electromagnetic relay into which an electromagnetic device according to an embodiment of the present invention has been incorporated.

Before continuing with the description of the present invention, the same reference numerals are provided to the same parts in the accompanying drawings.

In describing embodiments of the present invention and in describing configurations represented in the drawings, terms indicating directions such as "up", "down", "left", and "right", and other terms including those, will be used. The purpose for using those terms is to facilitate understanding of the embodiments through the drawings. Accordingly, those terms do not necessarily indicate directions used at the time of actually using the embodiments of the present invention. A technical scope recited in the claims shall not be restrictively interpreted by using those terms.

A description will be given of a case where an electromagnetic device according to the embodiment of the present invention is incorporated into an electromagnetic relay according to the accompanying drawings of FIGS. 1 to 7B.

Figure 2:
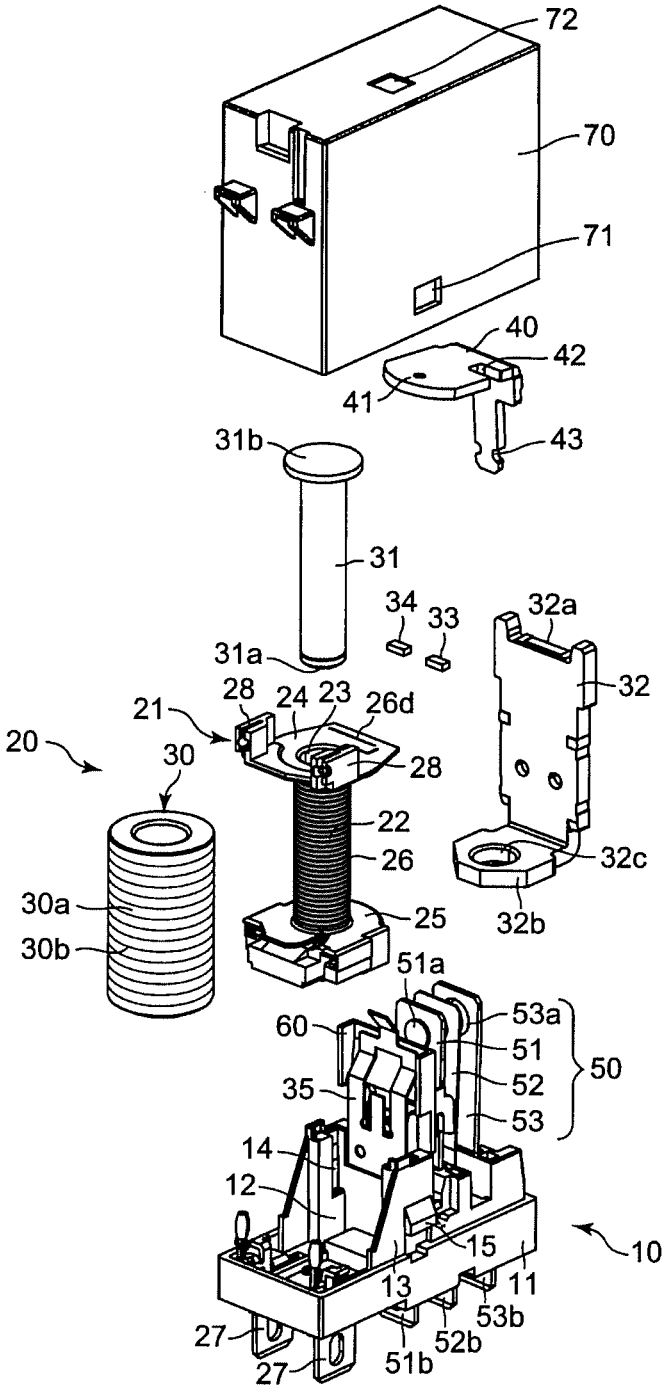
FIG. 2 is an exploded perspective view of the electromagnetic relay into which the electromagnetic device according to the embodiment of the present invention has been incorporated.

As illustrated in FIG. 2, an electromagnetic relay 10 includes a base 11, an electromagnetic device 20 installed on the base 11, a movable iron piece 40 that rotates based on excitation and demagnetization of the electromagnetic device 20, a contact mechanism 50 mounted on the base 11, a card 60 that drives the contact mechanism 50 via the movable iron piece 40, and a casing 70. For convenience of explanation, the casing 70 (see FIG. 2) is not illustrated in FIG. 1.

As illustrated in FIGS. 1 and 2, the base 11 is provided with a placement space 12 for installing the electromagnetic device 20 on one side of an upper surface of the base 11. Three terminal holes (not illustrated) are provided on the other side of the upper surface of the base 11 to form the contact mechanism 50.

In the placement space 12, terminal holes (not illustrated) for press-fitting coil terminals 27, 27 of the electromagnetic device 20 are provided at adjacent corner portions on the front side of the placement space 12 in FIG. 2. Further, the placement space 12 is provided with a rib 13 having a flat gate shape at the rear-side corner portion in FIG. 2. The rib 13 is provided with a press-fit groove 14 for press-fitting a yoke 32, which will be described later, into the corner portion of the inner side surface thereof. The rib 13 has, on its facing outer side surfaces, engaging claw portions 15 for fixing a casing 70, which will be described later, onto the rib 13.

As illustrated in FIG. 2, the electromagnetic device 20 includes a spool 21, a primary coil 30, an iron core 31, and the yoke 32.

Figure 5:
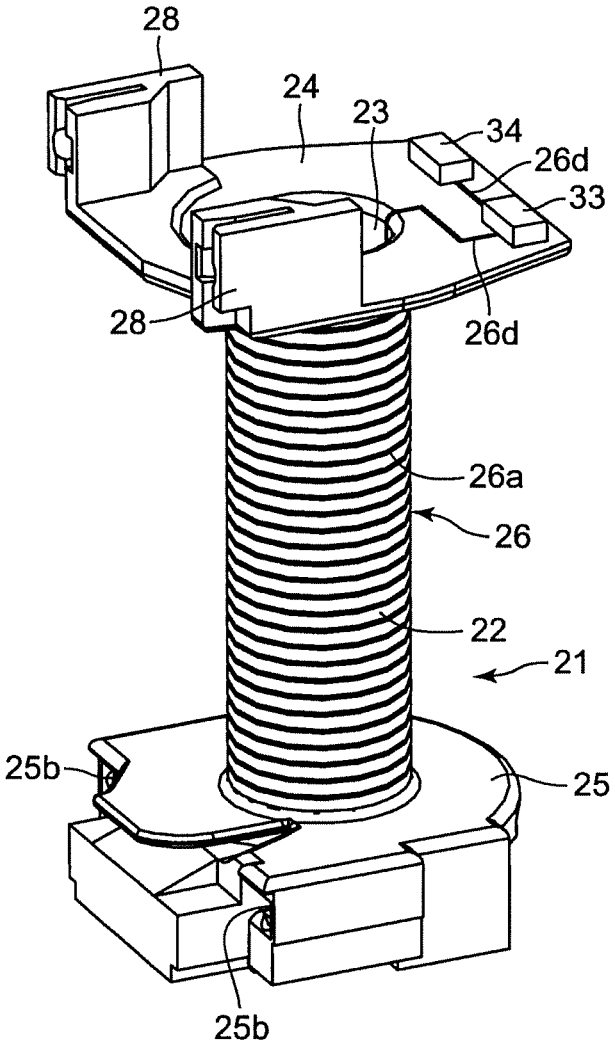
FIG. 5 is a perspective view illustrating a spool illustrated in FIG. 4.

As illustrated in FIG. 5, the spool 21 is formed of a cylindrical body 22 and guard portions 24, 25 formed integrally at both axial ends of the cylindrical body 22.

Figure 6A:
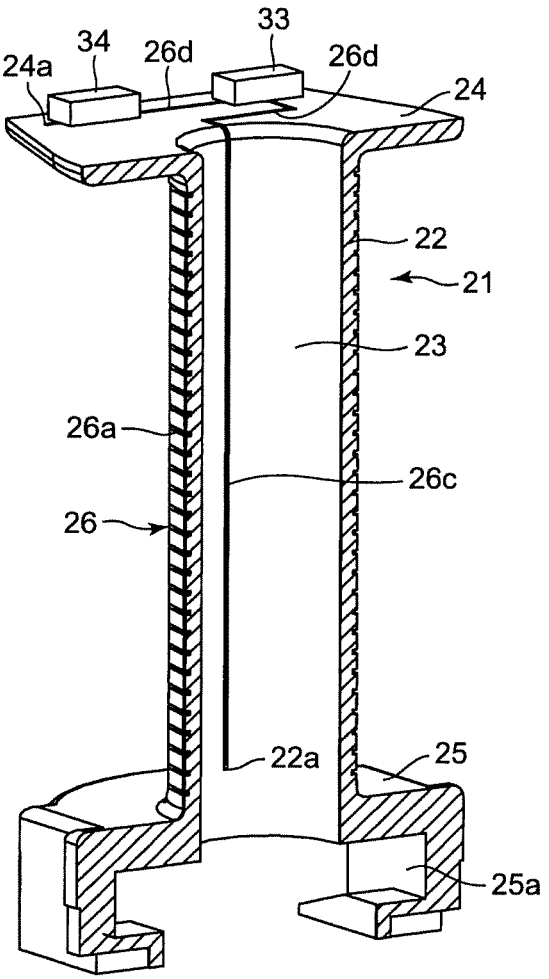
FIG. 6A is a longitudinal sectional perspective view of FIG. 5.
Figure 6B:
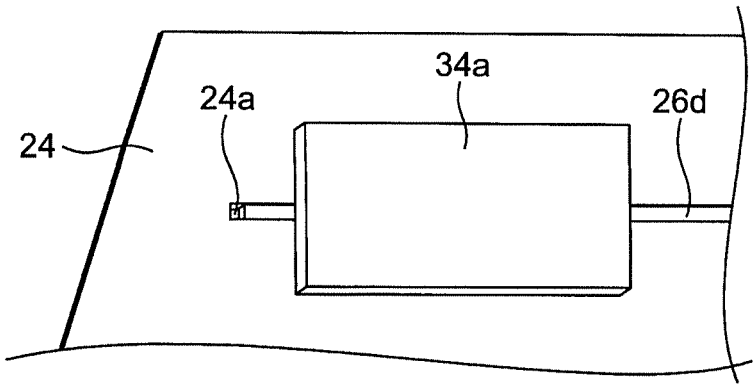
FIG. 6B is a partially enlarged perspective view of FIG. 6A.

As illustrated in FIGS. 6A and 6B, the cylindrical body 22 is provided with a through hole 23 in which the iron core 31 having a T-shaped cross section can be inserted from the upper opening to prevent it from coming off. Further, as illustrated in FIGS. 5 to 7B, a secondary coil 26 formed along the outer peripheral surface of the cylindrical body 22 is formed by the molded interconnect device (MID) molding method, for example. The MID molding method is a method in which a molded article made of a material obtained by mixing a resin and a conductive material is irradiated with a laser in a predetermined pattern to remove the resin and then metal plating is performed on the exposed conductive material, thereby forming a desired circuit pattern.

Figure 7A:
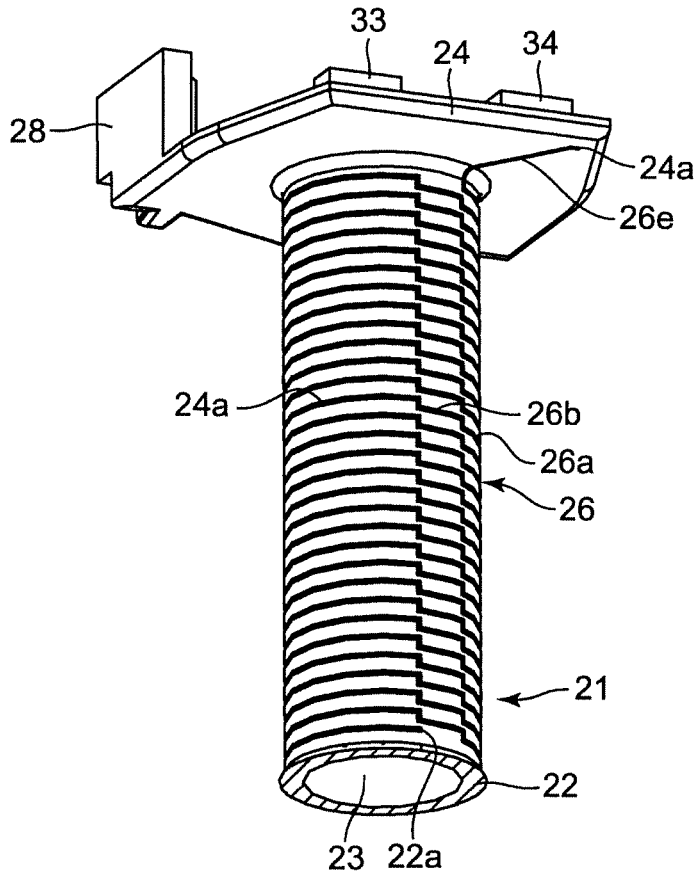
FIG. 7A is a transverse sectional perspective view of FIG. 5 as viewed from another viewpoint.
Figure 7B:
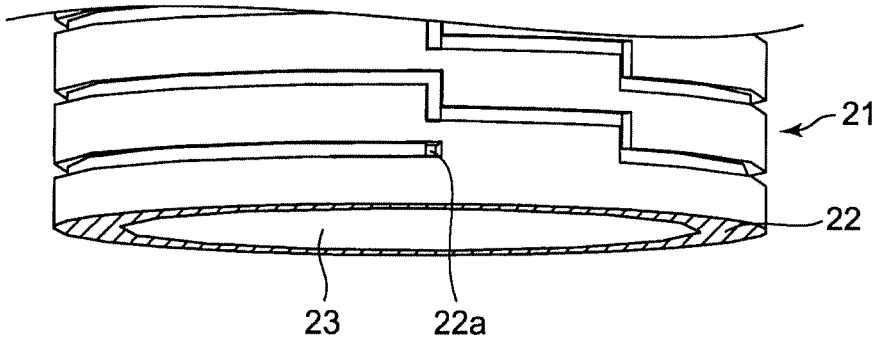
FIG. 7B is a partially enlarged perspective view of FIG. 7A.
Figure 8:
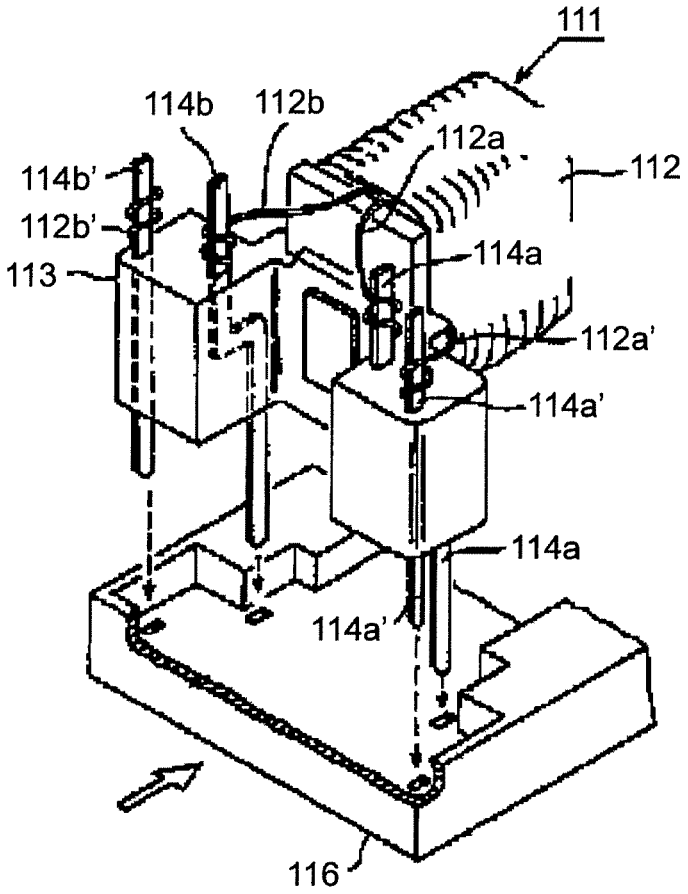
FIG. 8 is a perspective view of an electromagnetic device of Patent Document 1.

In the embodiment, as illustrated in FIGS. 5, 7A and 7B, patterns 26*a* are formed at predetermined pitches in the secondary coil 26, the patterns 26*a* extending in a circumferential direction along the outer peripheral surface of the cylindrical body 22 and being axially parallel to each other. Then, the patterns 26*a*, which are adjacent to each other vertically, are connected by a stepped auxiliary pattern 26*b* (FIG. 7A).

Further, as illustrated in FIG. 7B, the lower end of the secondary coil 26 is connected to a lead wire 26*c* (FIG. 6A) along the substantially axial direction on the inner peripheral surface of the through hole 23 of the cylindrical body 22 through a communication hole 22*a* provided in the cylindrical body 22, the lead wire 26*c* having been formed by metal plating by the MID molding method, for example. The lead wire 26*c* is connected to a lead wire 26*d* provided on the upper surface of the guard portion 24 by metal plating by the MID molding method, for example. The lead wire 26*d* is connected to a lead wire 26*e* (FIG. 7A) formed by metal plating on the rear surface of the guard portion 24 through a communication hole 24*a* (FIG. 6B) provided in the guard portion 24. The lead wire 26*e* is connected to the upper end of the secondary coil 26. Therefore, the secondary coil 26 forms a closed circuit.

Note that a light emitting element 33 and a resistor 34 are connected in series to the lead wire 26*d* formed in the guard portion 24 (FIG. 6A). The light emitting element 33 functions as an example of an operation indicator lamp, and as a specific example, it is a light-emitting diode (LED).

In the embodiment, the light emitting element 33 and the resistor 34 are directly connected to the lead wire 26*d* of the guard portion 24. There is thus an advantage that the number of parts and assembling steps in the assembling process are small, the productivity is high, and the electromagnetic device 20 which is space-saving can be obtained.

Figure 3:
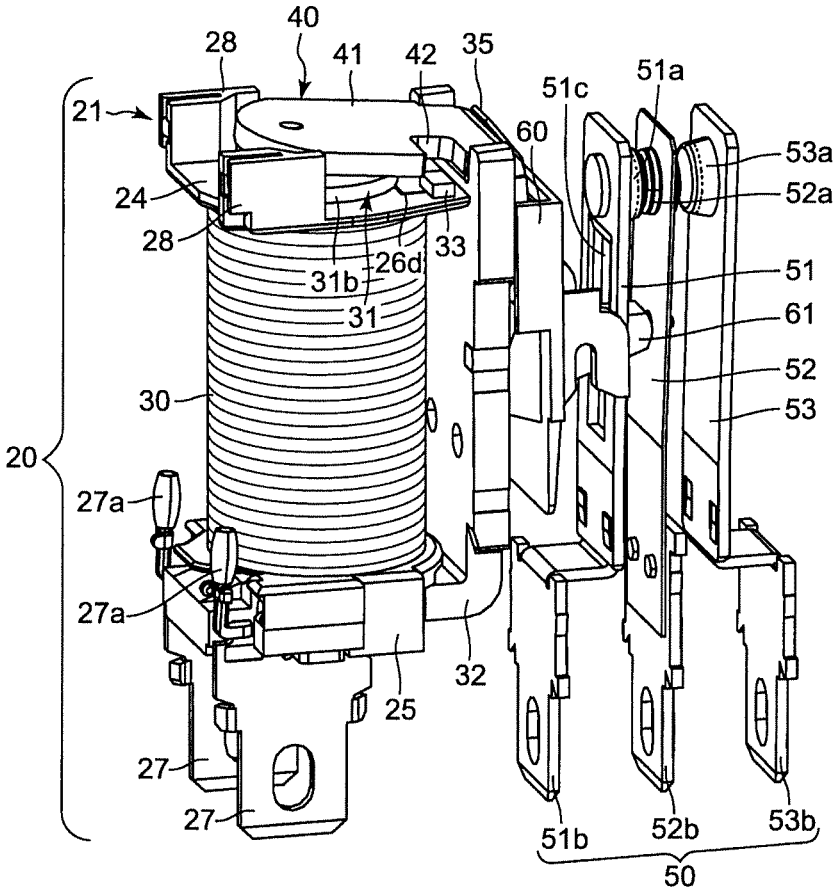
FIG. 3 is a perspective view illustrating a state where the base has been erased from FIG. 1.
Figure 4:
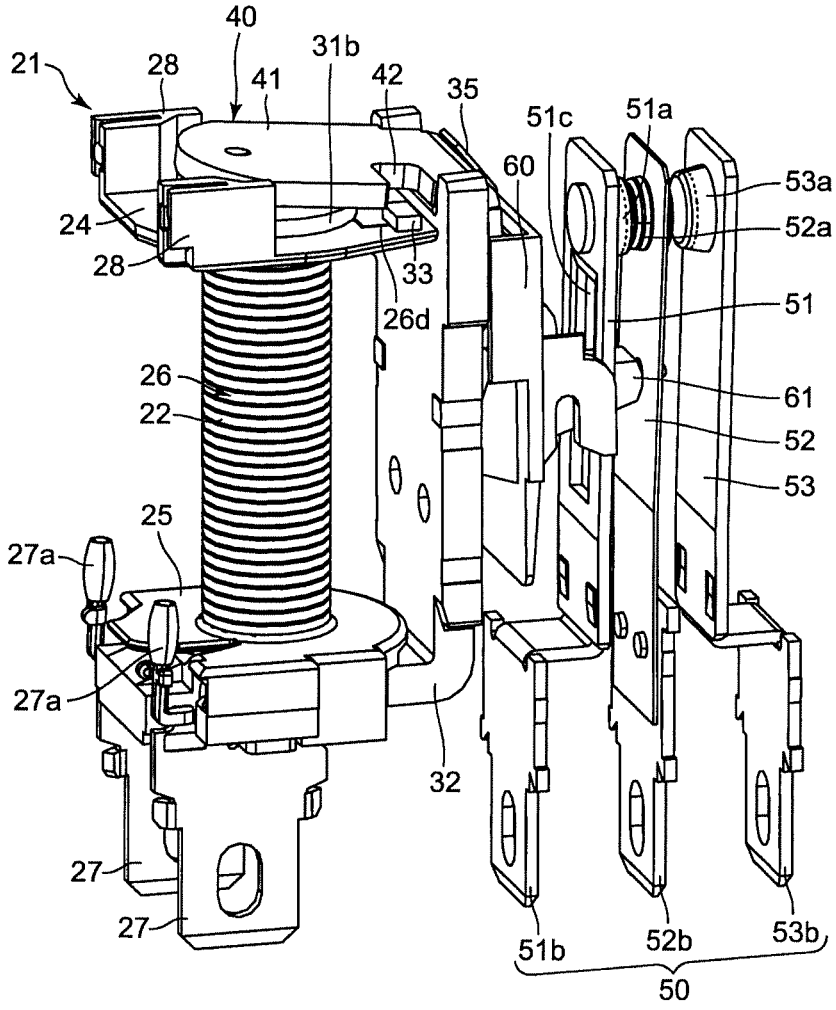
FIG. 4 is a perspective view illustrating a state where a primary coil has been erased from FIG. 3.

Further, as illustrated in FIG. 6A, the spool 21 is provided with a recess 25*a* for fitting the yoke 32, which will be described later, to the guard portion 25. In addition, as illustrated in FIG. 5, the coil terminals 27, 27 are press-fitted into terminal holes 25*b*, 25*b* provided on the side end face of the guard portion 25 (FIG. 4). An insulating film 30*a* is wound around the cylindrical body 22 of the spool 21 as an example of an insulating material, and a conductive wire 30*b* is wound around the insulating film 30*a* to form the primary coil 30, thus constituting the primary coil 30. A extended wire from the conductive wire 30*b* of the primary coil 30 is then soldered by being bound to binding portions 27*a*, 27*a* of the coil terminals 27, 27 (FIG. 3).

In the embodiment, ribs 28, 28 capable of press-fitting connection terminals (not illustrated) are formed on the guard portion 24 of the spool 21. This is because the spool 21 is used for assembling other electromagnetic relays.

The yoke 32 is a magnetic material having an L-shaped cross section, and as illustrated in FIG. 2, a support portion 32*a* is formed by cutting out the upper end thereof. Further, the yoke 32 has a caulking hole 32*c* in a horizontal portion 32*b* of the yoke 32. Then, an iron core body of the iron core 31 is inserted into the through hole 23 of the cylindrical body 22 of the spool 21 around which the primary coil 30 is wound. A one end 31*a*, connected to one end of the iron core body and protruding like a guard from one end of the cylindrical body 22, is fixed, for example by caulking, to the caulking hole 32*c* of the yoke 32. Meanwhile, the other end, connected to the other end of the iron core body and protruding like a guard from the other end of the cylindrical body 22, is taken as a magnetic pole portion 31*b*. Therefore, the iron core 31 is a magnetic material (FIG. 2) having a T-shaped cross section made up of the iron core body with the one end 31*a* and the magnetic pole portion 31*b*, and the iron core body of the iron core 31 has a cross-sectional area capable of being inserted through the through hole 23 of the cylindrical body 22 of the spool 21.

As illustrated in FIG. 2, the movable iron piece 40 is formed of a magnetic material bent into a substantially L-shaped cross section. The movable iron piece 40 is rotatably supported around the support portion 32*a* of the yoke 32 via a hinge spring 35 fixed to the rear surface of the yoke 32, for example by caulking. As a result, the movable iron piece 40 has a horizontal portion (plate portion) 41 which faces so as to be able to contact and separate from the magnetic pole portion 31*b* of the iron core 31. In the movable iron piece 40, the horizontal portion 41 is provided with a notch 42 for visually checking the light emitting element 33. In other words, the notch 42 is configured to transmit the light, emitted by the light emitting element 33, to the outside.

As illustrated in FIG. 3, the contact mechanism 50 includes a fixed contact terminal 51 to which a normally closed fixed contact 51*a* is fixed, for example by caulking, a movable touch piece 52 to which a movable contact 52*a* is fixed, for example by caulking, and a fixed contact terminal 53 to which a normally open fixed contact 53*a* is fixed, for example by caulking As illustrated in FIG. 1, a terminal portion 51*b* of the fixed contact terminal 51, a terminal portion 52*b* of the movable touch piece 52, and a terminal portion 53*b* of the fixed contact terminal 53 are press-fitted into the base 11, to form the contact mechanism 50. As a result, the movable contact 52*a* faces the normally closed fixed contact 51*a* and the normally open fixed contact 53*a* so as to be able to contact and separate from each other.

As illustrated in FIGS. 1 to 4, the card 60 has a recess (not illustrated) engaging with a lower end 43 of the movable iron piece 40 on one side of the facing front and rear surfaces, while the card 60 has an operating protrusion 61 projecting from the other side thereof. Then, the card 60 engages the recess with the lower end 43 of the movable iron piece 40 assembled to the yoke 32. As a result, the operating protrusion 61 is pressure-welded to the movable touch piece 52 through a through hole 51*c* of the fixed contact terminal 51.

The casing 70 has a box shape that can be fitted to the base 11, and an engagement hole 71 is provided in the lower side edge of each of the facing side surfaces. The ceiling surface of the casing 70 is provided with an operation check window 72 through which the light emitting element 33 can be checked visually. An example of the operation check window 72 is a transparent window. That is, the operation check window 72 is disposed to face the notch 42, and is configured so as to guide the light, emitted by the light emitting element 33, to the outside through the notch 42 and the operation check window 72.

Next, the operation of the electromagnetic relay 10 will be described.

First, when no voltage is applied to the primary coil 30 of the electromagnetic device 20, as illustrated in FIG. 1, no induced current is generated in the secondary coil 26, and the light emitting element 33 is not lit. Further, the movable touch piece 52 biases the lower end 43 of the movable iron piece 40 via the card 60. The movable contact 52*a* is thus in contact with the normally closed fixed contact 51*a*. The horizontal portion 41 of the movable iron piece 40 is separated from the magnetic pole portion 31*b* of the iron core 31.

When a voltage is applied to the primary coil 30 for excitation, the magnetic line of force passing through the iron core 31 attracts the horizontal portion 41 of the movable iron piece 40 to the magnetic pole portion 31*b* of the iron core 31. Then, against the spring force of the movable touch piece 52, the movable iron piece 40 rotates around the support portion 32*a* of the yoke 32, and the lower end 43 of the movable iron piece 40 presses the card 60. Therefore, the operating protrusion 61 of the card 60 presses the movable touch piece 52, and the movable touch piece 52 rotates. As a result, the movable contact 52*a* is separated from the normally closed fixed contact 51*a*, and thereafter comes into contact with the normally open fixed contact 53*a*. Then, the horizontal portion 41 of the movable iron piece 40 is attracted to the magnetic pole portion 31*b* of the iron core 31.

When a voltage is applied to the primary coil 30, an induced current flows through the secondary coil 26 by electromagnetic induction, and the light emitting element 33 is lit via the lead wire 26*d* and the like. The light of the light emitting element 33 is then transmitted through the notch 42 of the movable iron piece 40 provided above the light emitting element 33 and the operation check window 72, and whether or not the light emitting element 33 is lit can be checked from the operation check window 72 of the casing 70. Hence in the embodiment, the light emitting element 33 continues to emit light while a voltage is applied to the primary coil 30, so that whether or not the electromagnetic relay 10 is in operation can be determined from the outside of the electromagnetic relay 10.

Note that at least a part of the casing 70 may have the operation check window 72 which is translucent or transparent so that the light of the light emitting element 33 can be visually checked from the outside.

Subsequently, when the application of the voltage to the primary coil 30 is stopped, the magnetic line of force passing through the iron core 31 disappears, and the movable touch piece 52 pushes back the movable iron piece 40 via the card 60. Thus, after being separated from the normally open fixed contact 53*a*, the movable contact 52*a* comes into contact with the normally closed fixed contact 51*a* and returns to its original position. Then, the induced current flowing through the secondary coil 26 disappears, and the light emitting element 33 is turned off. This enables visual checking that the electromagnetic relay 10 has stopped operating.

According to the embodiment, with the secondary coil 26 formed by metal plating, it is possible to obtain the electromagnetic device 20 more compact in size and smaller in bulk than that of the conventional example. Further, according to the embodiment, there is no need to bind the extended wire of the coil to the coil terminal as in the conventional example, thus facilitating the connection work, so that the electromagnetic device 20 with high productivity can be obtained.

In the embodiment, the light emitting element 33 is directly attached to the guard portion 24 of the spool 21. Therefore, it is unnecessary to attach the light emitting element 33 to the guard portion 24 of the spool 21 via the connection terminal. Furthermore, there is no need to electrically connect the light emitting element 33 to the connection terminal via a lead wire. This eliminates the need to do assembling work and soldering work on the connection terminal, and the electromagnetic device with high productivity can be obtained with small numbers of parts and assembling steps.

Further, the secondary coil 26 is formed in advance on the cylindrical body 22 of the spool 21 by metal plating, for example, the MID molding method, thus eliminating the need to do winding work on the secondary coil 26, so that the productivity is further improved.

Moreover, the light emitting element 33 is lit by an induced current flowing through the secondary coil 26. This eliminates the need to obtain the power, which is necessary for lighting the light emitting element 33, from an external power supply. As a result, it is unnecessary to connect the light emitting element 33 to the external power supply, and an electromagnetic device 20 having a simple structure can be obtained.

Although the secondary coil 26 of the electromagnetic device 20 according to the embodiment is provided with the stepped auxiliary pattern 26*b* in a part of the secondary coil 26, a smoothly continuous spiral secondary coil may be formed.

Further, the communication holes 22*a*, 24*a* of the spool 21 may be formed in a mortar shape in order to facilitate laser irradiation performed in the MID molding method.

A variety of embodiments of the present invention have been described in detail with reference to the drawings, and lastly, a variety of aspects of the present invention will be described.

A electromagnetic device according to one or more embodiments of the present invention includes: a spool having a cylindrical body with a through hole; a secondary coil formed in a spiral shape along an outer peripheral surface of the cylindrical body and formed with a closed circuit by metal plating; and a primary coil formed of a conductive wire wound around the secondary coil via an insulating material covering the secondary coil. An induced current, generated by applying a voltage to any one of the primary coil and the secondary coil, is allowed to flow to the other coil different from the one coil.

According to the first aspect of the present invention, with the secondary coil formed by metal plating, an electromagnetic device more compact in size and smaller in bulk than that of the conventional example can be obtained. Further, according to the first aspect of the present invention, there is no need to bind the extended wire of the coil to the coil terminal as in the conventional example, thus facilitating the connection work, so that an electromagnetic device with high productivity can be obtained.

According to a second aspect of the present invention, in the first aspect, the guard portion may be provided at at least one end of the cylindrical body, and both ends of the secondary coil, formed on an outer peripheral surface of the cylindrical body, are electrically connected to each other by a lead wire formed by metal plating through a communication hole provided in the cylindrical body and the guard portion and an inner peripheral surface of the through hole in the cylindrical body.

According to the second aspect, both ends of the secondary coil are connected by metal plating, thus eliminating the need to connect the both ends by the lead wire of the conductive wire. This can lead to further reduction in the occupied space and the size. This further facilitates the connection work, thereby enabling saving of labor, so that an electromagnetic device with even higher productivity can be obtained.

In a third aspect of the present invention, in the second aspect, there may be provided an operation indicator lamp, fixed to the guard portion and electrically connected to the secondary coil.

According to the third aspect, the operation indicator lamp provided on the guard portion is electrically connected to the secondary coil, thereby facilitating the connection work on the operation indicator lamp. In addition, with the operation indicator lamp installed directly on the guard portion, a large wiring space is not required and the device can thus be made more compact in size. Furthermore, the operation indicator lamp is lit by the induced current generated at the time when a voltage is applied to the primary coil, and hence an electromagnetic device with an energy saving can be obtained.

In a fourth aspect of the present invention, in the third aspect, the operation indicator lamp may be a light-emitting diode (LED).

According to the fourth aspect, it is possible to obtain an electromagnetic device provided with an operation indicator lamp with a further energy saving.

An electromagnetic relay according to a fifth aspect of the present invention has a configuration in which the above electromagnetic device according to any one of the first to fourth aspects is incorporated into a base.

According to the fifth aspect of the present invention, the secondary coil is formed by metal plating, so that the electromagnetic device is more compact in size and smaller in bulk than that of the conventional example It is thus possible to obtain a compact electromagnetic relay. It is not necessary to bind the extended wire of the coil to the coil terminal as in the conventional example, thus facilitating the connection work, so that an electromagnetic relay with high productivity can be obtained.

According to a sixth aspect of the present invention, in the fifth aspect, a movable iron piece may be disposed so as to be attracted by magnetic force to a magnetic pole portion of an iron core protruding from the flange portion provided at at least one end of the cylindrical body among iron cores inserted through the through holes of the spool, the magnetic force being generated by applying a voltage to any one of the primary coil and the secondary coil, and the movable iron piece may be provided with a notch through which light of the operation indicator lamp is transmitted.

According to the sixth aspect, the light of the operation indicator lamp provided on the guard portion of the electromagnetic device transmits through the notch provided in the movable iron piece, so that the light can be checked visually. It is therefore possible to visually check an operating state through the notch, thereby to obtain an electromagnetic relay with high safety and a user's sense of security.

According to a seventh aspect of the present invention, in the sixth aspect, there may be provided an operation check window configured to transmit the light of the operation indicator lamp on an outer peripheral surface of a casing fitted to the base.

According to the seventh aspect, the operation indicator lamp can be checked through the operation check window provided in the casing, and an electromagnetic relay with good usability can be obtained.

According to an eighth aspect of the present invention, in the seventh aspect, the operation check window may be a transparent window provided in the casing.

According to the eighth aspect, with no through hole provided in the casing, no fault occurs based on intrusion of dust or the like, and there is an effect that an electromagnetic relay with high reliability can be obtained.

Note that by appropriately combining freely selected embodiments or modifications of the above variety of embodiments and modifications, it is possible to achieve the respective effects of those combined. While it is possible to combine embodiments, combine examples, or combine an embodiment and an example, it is also possible to combine features in different embodiments or examples.

The electromagnetic device and the electromagnetic relay using the electromagnetic device according to the present invention are not limited to the above electromagnetic device and may be applied to other electromagnetic devices and electromagnetic relays incorporating the electromagnetic devices.

While the present invention has been fully described in connection with the preferred embodiments with reference to the accompanying drawings, a variety of modifications or corrections will be apparent to those skilled in the art. Such modifications or corrections are to be understood as being included in the scope of the invention according to the appended claims so long as not deviating therefrom.

DESCRIPTION OF SYMBOLS

10 electromagnetic relay
11 base
12 placement space
13 rib
14 press-fit groove
15 engaging claw portion
20 electromagnetic device
21 spool
22 cylindrical body
**22*a*** communication hole
23 through hole
24 guard portion
25 guard portion
**24*a*** communication hole
26 secondary coil
**26*a*** pattern
**26*b*** auxiliary pattern
**26*c*** lead wire
**26*d*** lead wire
**26*e*** lead wire
30 primary coil
31 iron core
**31*b*** magnetic pole portion
32 yoke
33 light emitting element

34 resistor
35 hinge spring
40 movable iron piece
41 horizontal portion
42 notch
50 contact mechanism
51 fixed contact terminal
51*a* normally closed fixed contact
52 movable touch piece
52*a* movable contact
53 fixed contact terminal
53*a* normally open fixed contact
60 card
61 operating protrusion
70 casing
71 engagement hole
72 operation check window

The invention claimed is:

1. An electromagnetic device comprising:

a spool having a cylindrical body with a through hole;

a secondary coil formed in a spiral shape along an outer peripheral surface of the cylindrical body and formed with a closed circuit by metal plating; and a primary coil formed of a conductive wire wound around the secondary coil via an insulating material covering the secondary coil, wherein an induced current, generated by applying a voltage to any one of the primary coil and the secondary coil, is allowed to flow to the other coil different from the one coil, wherein a guard portion is provided at at least one end of the cylindrical body, and wherein both ends of the secondary coil, formed on the outer peripheral surface of the cylindrical body, are electrically connected to each other by a lead wire formed by metal plating through a communication hole provided in the cylindrical body and the guard portion and an inner peripheral surface of the through hole in the cylindrical body.

2. The electromagnetic device according to claim 1, further comprising:

an operation indicator lamp fixed to the guard portion and electrically connected to the secondary coil.

3. The electromagnetic device according to claim 2, wherein the operation indicator lamp is a light-emitting diode.

4. An electromagnetic relay comprising:

a base; and an electromagnetic device incorporated into the base, and comprising:

a spool having a cylindrical body with a through hole;

a secondary coil formed in a spiral shape along an outer peripheral surface of the cylindrical body and formed with a closed circuit by metal plating; and a primary coil formed of a conductive wire wound around the secondary coil via an insulating material covering the secondary coil, wherein an induced current, generated by applying a voltage to any one of the primary coil and the secondary coil, is allowed to flow to the other coil different from the one coil, wherein a movable iron piece is disposed so as to be attracted by magnetic force to a magnetic pole portion of an iron core protruding from the guard portion provided at at least one end of the cylindrical body among iron cores inserted through the through holes of the spool, the magnetic force being generated by applying a voltage to any one of the primary coil and the secondary coil, and wherein the movable iron piece is provided with a notch through which light of the operation indicator lamp is transmitted.

5. The electromagnetic relay according to claim 4, further comprising:

an operation check window configured to transmit the light of the operation indicator lamp on an outer peripheral surface of a casing fitted to the base.

6. The electromagnetic relay according to claim 5, wherein the operation check window is a transparent window provided in the casing.

* * * * *